US006878019B2

(12) United States Patent
Kanno et al.

(10) Patent No.: US 6,878,019 B2
(45) Date of Patent: Apr. 12, 2005

(54) WATERCRAFT CONTROL SYSTEMS

(75) Inventors: Isao Kanno, Shizuoka (JP); Takashi Okuyama, Shizuoka (JP)

(73) Assignee: Yamaha Marin Kabushiki Kaisha, Shizuoka-ken (JP)

( * ) Notice: Subject to any disclaimer, the term of this patent is extended or adjusted under 35 U.S.C. 154(b) by 0 days.

(21) Appl. No.: 10/280,262

(22) Filed: Oct. 24, 2002

(65) Prior Publication Data

US 2003/0089291 A1 May 15, 2003

(30) Foreign Application Priority Data

Oct. 25, 2001 (JP) ..... 2001-327408

(51) Int. Cl.[7] ..... B63H 21/22; B63H 23/00
(52) U.S. Cl. ..... 440/1; 114/144 A
(58) Field of Search ..... 441/80, 89; 440/1; 114/144 A

(56) References Cited

U.S. PATENT DOCUMENTS

| | | | | |
|---|---|---|---|---|
| 4,305,143 | A | * 12/1981 | Simms et al. | 367/134 |
| 4,497,057 | A | 1/1985 | Kato et al. | |
| 4,630,205 | A | * 12/1986 | Otaka | 701/70 |
| 4,796,206 | A | 1/1989 | Boscove et al. | |
| 5,245,324 | A | 9/1993 | Jonker et al. | |
| 5,325,082 | A | 6/1994 | Rodriguez | |
| 5,352,138 | A | 10/1994 | Kanno | |
| 5,463,598 | A | * 10/1995 | Holland et al. | 367/131 |
| 5,632,217 | A | 5/1997 | Ford et al. | |
| 5,838,227 | A | * 11/1998 | Murray | 340/539.21 |
| 5,852,789 | A | 12/1998 | Trsar et al. | |
| 5,904,604 | A | 5/1999 | Suzuki et al. | |
| 5,935,187 | A | 8/1999 | Trsar et al. | |
| 6,015,319 | A | 1/2000 | Tanaka | |
| 6,055,468 | A | 4/2000 | Kaman et al. | |
| 6,057,759 | A | * 5/2000 | Marsh | 340/539.11 |
| 6,141,608 | A | 10/2000 | Rother | |
| 6,150,928 | A | * 11/2000 | Murray | 340/426.14 |
| 6,308,651 | B2 | 10/2001 | McKenney et al. | |
| 6,401,028 | B1 | 6/2002 | Kamiya et al. | |
| 2001/0049579 | A1 | 12/2001 | Fujino et al. | |
| 2002/0052159 | A1 | * 5/2002 | Eguchi | 441/80 |

FOREIGN PATENT DOCUMENTS

| | | |
|---|---|---|
| EP | 0 341 906 | * 11/1989 |
| JP | 5-185987 | 7/1993 |
| JP | 6-26878 | 2/1994 |
| WO | 90/08060 | * 7/1990 |
| WO | 94/06679 | * 3/1994 |

OTHER PUBLICATIONS

ISO, "*International Standard ISO 11783–5*," First edition May 1, 2001.

* cited by examiner

*Primary Examiner*—Sherman Basinger
(74) *Attorney, Agent, or Firm*—Knobbe, Martens, Olson & Bear, LLP

(57) ABSTRACT

A watercraft control system includes a transmitting device and a watercraft control device which receives transmitted signals from the transmitting device and maneuvers the watercraft to a fallen driver, pursues a diver, or the like. The transmitting device can also unlock various devices and systems on the watercraft by generating an authentic ID code. In other embodiments, a signal intensity is monitored to trigger a guidance system, while still other embodiments replace the transmitting device with on-board sonar systems.

14 Claims, 18 Drawing Sheets

WATERCRAFT CONTROL SYSTEMS

REFERENCE TO RELATED APPLICATION

The present application claims priority benefit under 35 U.S.C. §119 from Japanese Patent Application No. 2001-327408, filed Oct. 25, 2001, which is incorporated herein by reference.

FIELD OF THE INVENTION

The present invention relates in general to the field of watercraft control systems, and, in particular, relates to watercraft control systems for recognizing a user through a transmission device, unlocking and preparing the watercraft for use based on the recognition, guiding a watercraft to a location of a fallen driver or passenger, guiding the watercraft in pursuit of a moving target, or the like.

BACKGROUND OF THE INVENTION

Current watercraft include a number of sophisticated operational controls. For example, an exemplary watercraft can include power output control and steering for a propulsion device, such as an outboard motor having a jet, a propeller, or propulsion mechanisms. In addition, a watercraft may also include lock and unlock control for steering devices, a start and stop (or on and off) for electrical and/or propulsion systems, or the like.

Although the foregoing operational controls enable a user to operate the watercraft, the foregoing operational controls are each actuated by one or more mechanical user interfaces. For example, actuation of the operational controls can include the turning of a steering mechanism, the insertion and/or operation of an ignition key, the movement of a throttle lever or the like. However, there may be circumstances in which mechanical actuation of one or more of the foregoing controls is less convenient or is not possible.

In addition to the foregoing drawbacks, when a driver or passenger falls from a watercraft or otherwise moves in a direction away from a watercraft, such as when diving or swimming, that person often must swim a long distance to return to the watercraft. Additionally, if the watercraft is not disabled by the separation, the watercraft could continue on a course away from the separated person in a dangerous uncontrolled and unreturnable manner.

SUMMARY OF EMBODIMENTS OF THE INVENTION

Embodiments of the present invention seek to overcome some or all of these and other drawbacks. One aspect of embodiments in accordance with the present invention is a watercraft control system that provides remote wireless activation of one or more operational controls, thereby advantageously providing watercraft control in a convenient and remote manner. For example, an embodiment includes a user-transportable wireless transmission device, such as a smart card, configured to transmit an ID code to a control system of a watercraft.

The watercraft control system also includes a receiver in communication with a processor to verify the transmitted ID code and to output appropriate control signals to the watercraft operational controls, such as, for example, power output control and steering for propulsion devices, lock and unlock control for steering devices, start and stop control (on and off) for electrical and/or propulsion systems, or the like. In an embodiment, when the control system verifies that the ID code is authentic, the control system adjusts one or more operational controls to ready the watercraft for use. For example, the control system can unlock a steering device, provide power to electrical or propulsion systems, adjust rigging equipment to operating configurations positions or the like. According to an embodiment, subsequent activation of the wireless transmission device can reverse the foregoing operations, effectively adjusting the one or more operational controls to discontinue watercraft use.

In another embodiment, the watercraft control system includes a plurality of wireless transmission devices, each device transmitting authentic ID codes that are distinguishable by the control system. In such an embodiment, the control system advantageously includes operational parameters associated with each ID code. For example, a first ID code may cause the control system to configure the operational controls of the watercraft for a first use, such as, for example, low speed operation, while a second ID code may cause the control system to configure the operational controls for a second use, such as high speed operations. Moreover, the ID codes may configure the height, resistance, positioning, or the like, of the mechanically-controlled devices such as the steering, throttle, or the like.

In another embodiment, the watercraft control system includes a guidance system, such as an autopilot, for moving the watercraft to a specific location. For example, the guidance system advantageously outputs control commands or signals to operate the watercraft. The guidance system advantageously includes a global positioning system (GPS) configured to provide accurate positioning information to the control system. The guidance system can be selectively activated to accomplish a plurality of tasks, including returning to the proximity of a fallen user, a diver, or a user who is otherwise stationary or moving. For example, the control system monitors the intensity of a transmitted signal from the wireless transmission device. When the intensity falls below a threshold, the control system determines that the holder of the transmission device has fallen from the watercraft, that the holder of the transmission device is moving away from the watercraft, or the like, thus causing the decrease in transmitted signal intensity. In such cases, the guidance system advantageously activates the GPS to determine a location, for example, a current, past, or default location and to output control commands to return the watercraft to that location. In certain embodiments, the location is in the proximity of the fallen driver or passenger.

According to another embodiment, the guidance system includes one or more directional antennas that are employable to provide directional signal intensity information usable by the guidance system to determine the approximate location of the user. According to another embodiment, the guidance system advantageously includes sonar equipment and recognition processing to identify a human shape or another shape in the water and determine the approximate location thereof with or without user transmission devices.

In another embodiment, once the guidance system has returned the watercraft to the location, the control system may activate one or more audio or visual alarms to indicate that the watercraft is operating in a pursuit mode and is pursuing, for example, a fallen driver, a diver or the like. The alarms may include, activation of lights, speakers, horns, or the like.

For purposes of summarizing the invention, certain aspects, advantages and novel features of the invention have been described herein. Of course, it is to be understood that not necessarily all such aspects, advantages or features will be embodied in any particular embodiment of the invention.

BRIEF DESCRIPTION OF THE DRAWINGS

A general architecture that implements the various features of the invention will now be described with reference to the drawings. The drawings and the associated descriptions are provided to illustrate embodiments of the invention and not to limit the scope of the invention. Throughout the drawings, reference numbers are re-used to indicate correspondence between referenced elements. In addition, the first digit of each reference number indicates the figure in which the element first appears.

DETAILED DESCRIPTION OF EMBODIMENTS OF THE INVENTION

Figure 1:
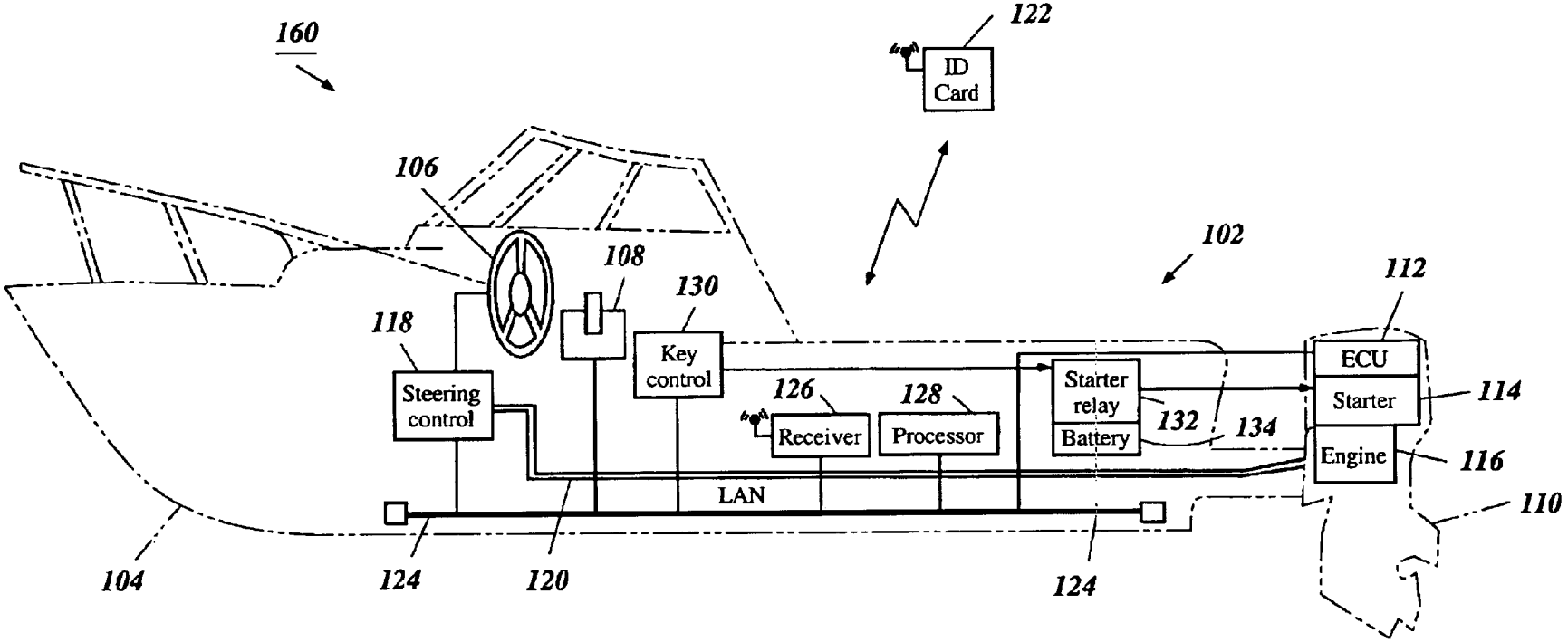
FIG. 1 is a block diagram of an embodiment of a control system of a watercraft, including an exemplary watercraft in phantom.

A watercraft control system includes a transmitting device and a watercraft control device connectable from said transmitting device by wireless communication, such as, for example radio frequency (RF) communication, ultrasonic communication, or the like. The transmitting device comprises a memory that stores a valid identification (ID) code and a transmitter transmitting the ID code that uses a radio or ultrasound signal. In an embodiment, the transmission device stores the ID code in a non-volatile manner. The watercraft control system includes a receiver that receives the transmitted signal. A processor recognizes the ID code, determines whether it is authentic, and, when appropriate, outputs a signal canceling at least an operation-lock of the watercraft.

In one embodiment, the transmission device transmits the ID code upon activation or actuation of an appropriate button thereon. In other embodiments, the transmission device continually transmits the ID code. By verifying the ID code, the control system advantageously brings the watercraft to a watercraft maneuvering condition without need of a key operation. For example, the control system can unlock a steering device, power electrical systems, enable propulsion systems, start the engine, adjust rigging equipment into operating positions, perform combinations of the same, or the like. According to an embodiment, subsequent activation of the wireless transmission device or subsequent reception of a differing signal advantageously reverses the foregoing operations, effectively adjusting the one or more operational controls to discontinue watercraft use.

According to one embodiment, the transmission device comprises a shape suitable for carrying and ease of use, such as, for example, a card housing electronic components. Alternatively, the shape can include stick-like shapes, block-like shapes, or the like. The card may be shaped to provide, or include attachment mechanisms for providing, ease of attachment to, for example, a life preserver or jacket, a diving suit, or the like. In one embodiment, the transmitting device transmits a signal appropriate for the medium through which the signal will pass, such as, for example, a radio or other frequency signal when transmitting through the air, and an ultrasonic or other signal when transmitting through water. In one embodiment, the transmission device may transmit signals at a low enough power to be effectively received only within about one meter of a receiving device.

In an embodiment, the ID code is prepared specific to an individual user such that the receiving control system can differentiate between a plurality of users. Then, the control system can output control signals designed to configure the operational controls of the watercraft according to associated control characteristics, such as, for example, throttle opening versus throttle lever tilt angle, or the like, which are customized and prestored for to each user.

According to one embodiment, the transmission device or transmitter and the receiving device or receiver can include encryption mechanisms designed to ensure transmission of an authentic ID code. For example, when a code is ciphered by a predetermined rule, straightforward copying of the transmitting device can be made practically impossible. The rule may correspond to a key for ciphering and deciphering, such as, for example, commercially available public and private key encryption mechanisms.

According to another embodiment, the watercraft control system advantageously includes a guidance system. The watercraft control system can trigger the guidance system when, for example, the receiving device receives a signal having, for example, an intensity such as a measurement of the signal-to-noise ratio, below a threshold value. When the intensity falls below the threshold, the guidance system may be activated to identify a location of the watercraft and generate engine control signals and steering control signals for guiding the watercraft to the location or for pursuing a moving target. Thus, the guidance system may determine that the location where the intensity fell below the predetermined threshold approximately coincides with where, for example, a driver fell in the water.

Thus, if the driver or other holder of a recognized transmission device falls from the watercraft, the control system can guide the watercraft to advantageously return to a location proximate to where the driver fell in the water. Alternatively, the foregoing system also allows the watercraft to pursue, for example, a diver in water. Also, the foregoing system allows the watercraft to effectively pursue or follow a non-driver who is diving or otherwise moving in or with water.

According to one embodiment, when the watercraft arrives at the location, or during the return trip to the location, or when the control system determines the signal intensity is below the threshold, the control system activates an audible/visual alarm, such as, for example, flashing emergency lights, sounding horns, communicating messages through speakers, or the like, informing those perceiving the alarm that the watercraft is operating in a rescue or pursuing mode.

According to one embodiment, the guidance system advantageously includes a global position system (GPS), or one or more directional antennas that are moved, for example, in a scanning fashion, or the like. Moreover, the guidance system may continually monitor the location of the watercraft in order to properly guide the watercraft to the destination, such as, for example, proximate a fallen driver.

According to another embodiment, the guidance system includes one or more sonar transmitting devices emitting one or more sonic waves and one or more sonar receiving devices for receiving the sonic waves. The guidance system, the control system or both systems may advantageously process the received sonic waves to identify a human or other shape, and output controls to the watercraft to guide the watercraft proximate to the shape.

To facilitate a complete understanding of the invention, the remainder of the detailed description describes the invention with reference to the drawings.

Figure 2:
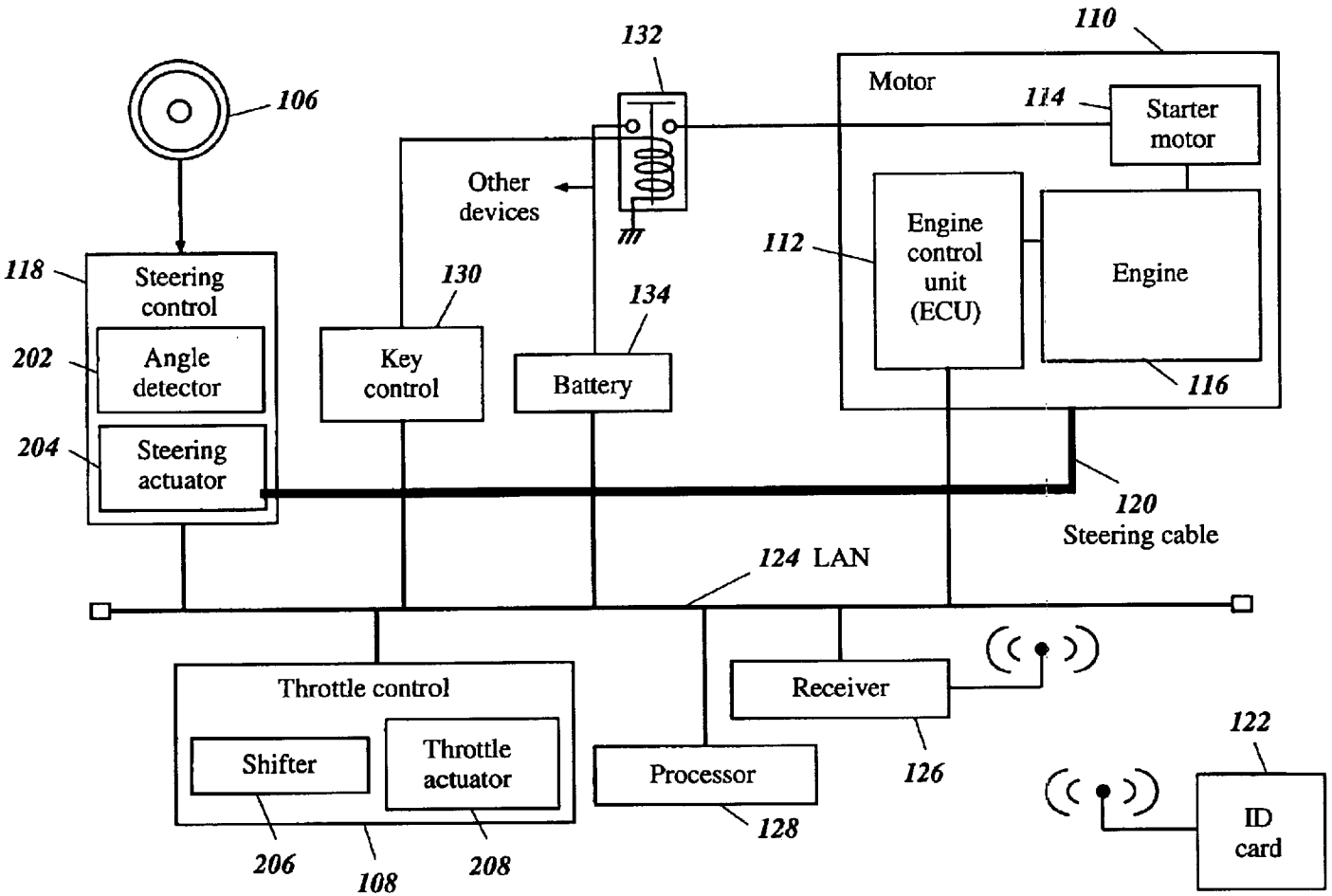
FIG. 2 is a more detailed block diagram of the control system of FIG. 1.

FIGS. 1 and 2 illustrate a block diagram of a control system 100, according to an embodiment of the invention, that provides for convenient and remote wireless activation of one or more operational controls of a watercraft 102 having a hull 104. The watercraft 102 may include any vessel for transporting one or more users over water. The watercraft 102 is depicted in FIG. 1 in phantom as an exemplary embodiment that includes a steering device 106, such as a helm, a throttle actuator or control 108, and a motor 110. The motor 110 may include an electronic control unit (ECU) 112, a starter motor 114, and an engine 116, as is generally known in the watercraft industry. The steering device 106 may include a steering control 118 connected to a steering cable 120 for displacing a propulsion device or the like, thereby steering the watercraft 102, also as is generally known in the watercraft industry.

As shown in FIGS. 1 and 2, the control system 100 includes a, user-transportable, wireless transmission device, such as a smart ID card 122, configured to transmit an ID code and disclosed in greater detail below with reference to FIG. 3. According to one embodiment, the control system 100 includes a communication bus and associated protocol, such as, for example, a local area network (LAN) 124 for facilitating communication between electronic components of the control system 100. For example, a receiver 126, a processor 128, key control 130, the steering control 118, the throttle control 108 and the ECU 112 communicate with one another through the LAN 124. In addition, the key control 130 communicates with a starter relay 132, which connects a power source such as a battery 134 to the starter motor 114 for starting the engine 116.

According to an embodiment, when a person carrying the transmission device or ID card 122 approaches the watercraft 102, the receiver 126 receives the transmitted ID code and supplies it to the processor 128 through the LAN 124. The processor 128 processes the ID code to verify it to be authentic, such as, for example, by performing encryption/decryption, matching a predetermined code or portion of a predetermined code, or performs both operations. When a match is found, the processor 128 outputs an unlock signal to, for example, on or more of the steering control 118, the throttle control 108, and the key control 130, thereby readying the watercraft 102 for use. Moreover, such processor output may cancel a condition of start-prohibition of one or more engine starting devices, such as a key control 130, a starter relay 132, or the starter motor 114. Further, the processor output may cause the key control 130 to activate the starter relay 132, thereby starting the engine 116. In addition, the processor 128 may output other watercraft readiness commands, such as, for example, adjusting rigging equipment into operating position or the like.

According to an embodiment where activation of the ID card 122 causes the processor 128 to perform the foregoing functions, subsequent activation of the ID card 122 may reverse the foregoing operations, effectively adjusting one or more operational controls to discontinue watercraft use.

FIG. 2 illustrates a block diagram of the control system 100 according to an embodiment of the invention. As shown in FIG. 2, the steering control 118 further comprises an angle detector 202 for detecting a handle angle of the steering device 106 and a steering actuator 204 for generating a displacement corresponding to the detected handle angle. The steering actuator 204 transmits the generated displacement, for example, through the steering cable 120 to the motor 110 or propulsion device for mechanical displacement thereof, thereby providing steering of the watercraft 102. The steering control 118 also transmits the generated displacement to the processor 128 through LAN 124.

FIG. 2 also shows the throttle control 108, which includes a shifter 206 for sending shifting operations and a throttle actuator 208 for sending throttling operations to the ECU 112 through the LAN 124. The shifting operations and the throttling operations are inputted, for example, as a tilt angle of a lever (not shown). When lever is tilted forward by a certain angle, the shift operation changes, for example, a propulsion device from neutral to normal (forward), and as the lever is tilted further forward, the throttling operation increases throttle opening. Also, when the lever is tilted rearward by a certain angle, shift operation changes from neutral to reverse (backward), and as the lever is tilted further rearward, the throttling operation increases throttle opening.

In one embodiment, the ECU 112 outputs a signal for an actuator (not shown) to generate a mechanical displacement for opening or closing a throttle valve (not shown) and for movement of a shift mechanism, according to information from the throttle control 108. Sensors (not shown) may detect the opening and closing conditions of the throttle valve, shifting conditions, engine speed or the like, and supplies information responsive to the detected conditions to the ECU 112.

In general, an ordinary key-input operation signals the key control 130 to activate the starter relay 132, thereby providing electrical power to the starter motor 114. However, the key control 130 also connects through the LAN 124 to lock and unlock the steering control 118, the throttle control 108, and the like. As described in the foregoing, the processor 128 can also respond to the receipt of a valid ID code from the receiver 126 output signal that locks, and in some embodiments, unlocks the foregoing controls.

Figure 3:
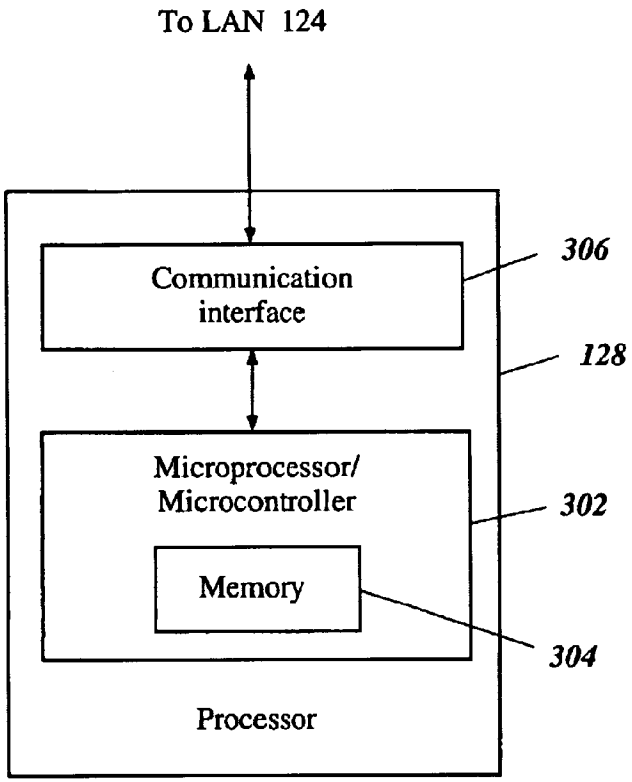
FIG. 3 is a block diagram of a processor of the control system of FIGS. 1 and 2.

FIG. 3 is a block diagram of the processor 128 of the control system 100 according to an embodiment of the invention. As shown in FIG. 3, the processor 128 includes a microprocessor/microcontroller 302 that accesses a memory 304 and that communicates through a communication interface 306. The controller 302 performs calculations using information obtained through the communication interface 306 or information stored in the memory 304. The communication interface 306 controls data communication between the LAN 124 and the controller 302. Although disclosed as a processor or a controller, the controller 302 may advantageously comprise a general or specific purpose computing device that includes commercially available hardware and software.

Figure 4:
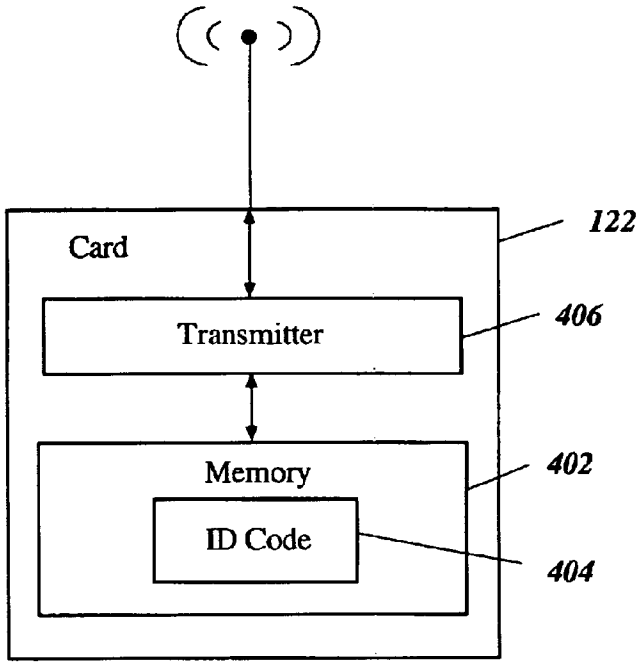
FIG. 4 is a block diagram of a transmission device of the control system of FIGS. 1 and 2.

FIG. 4 is a block diagram of the transmission device, such as the ID card 122 of the control system 100, according to an embodiment of the invention. As shown in FIG. 4, the ID card 122 includes a non-volatile memory 402 that stores at least an ID code 404. The memory 402 may also include information specific to a user, such as, for example, identification information including driver license number, social security number, one or more biometrics, ciphering or deciphering information, or the like. According to one embodiment, transmitter 406 transmits the ID code 404 when the ID card 122 is activated, actuated, or the like. According to another embodiment, the transmitter 406 transits the ID code 404 continually.

Figure 5:
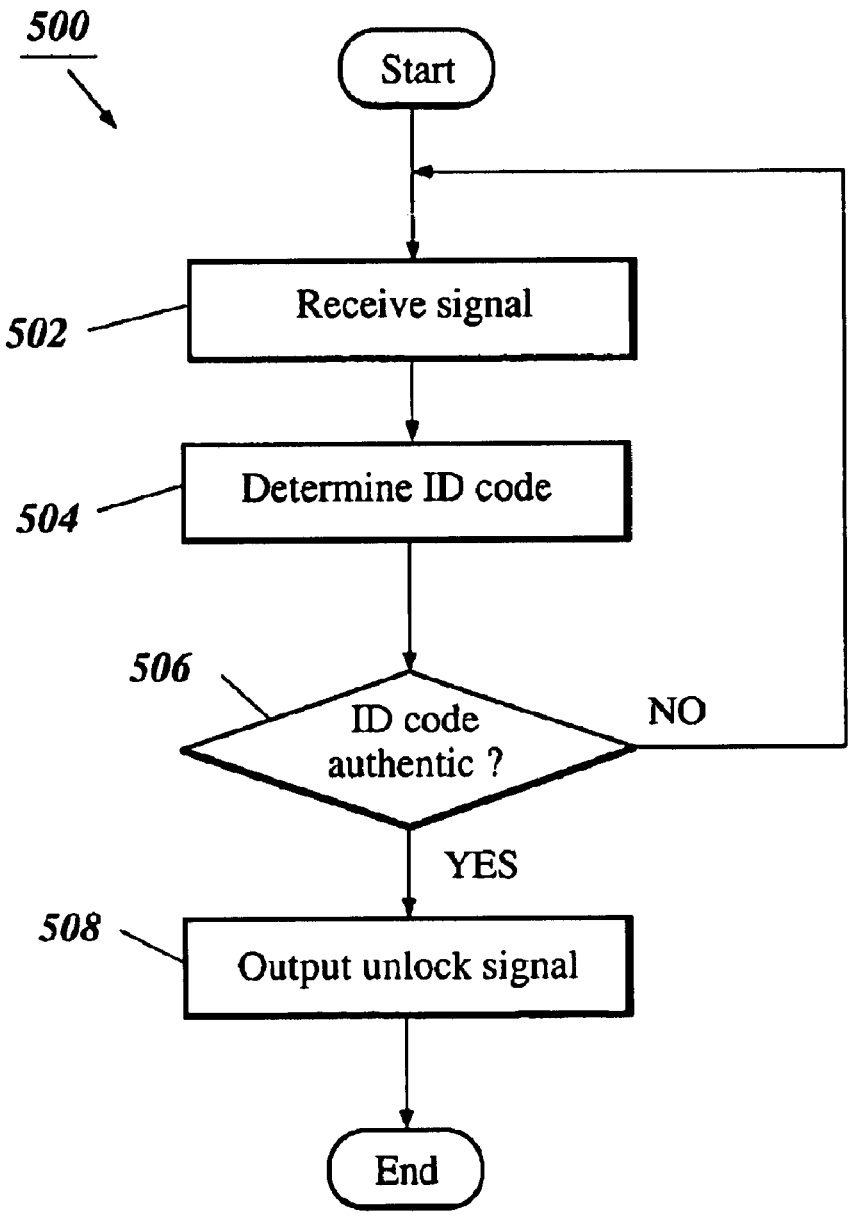
FIG. 5 is a flowchart of an unlocking process performed by the control system of FIGS. 1 and 2.

FIG. 5 is a flowchart of an unlocking process 500, according to an embodiment of the invention. The unlocking process 500 begins in a block 502, where, for example, a user carrying the ID card 122 approaches the watercraft 102. At a block 504, the receiver 126 receives at least the ID code 404 and transfers the same to the processor 128. The processor 128 processes the received signal to, for example, decipher the signal and to determine the ID code 404. At a block 506, the processor 128 determines whether the received ID code 404 is valid by, for example, comparing the code with expected, authorized, or stored codes or data. When the ID code 404 is not valid, the process 500 returns to the block 502 to attempt to receive the same code or a different code. Alternatively, the process 500 may end.

When the ID code 404 is valid, the process 500 proceeds to a block 508, where the processor 128 outputs a signal to unlock various operational controls and ready the watercraft 102 for use, customize the watercraft to a user, or the like, as disclosed above.

Based on the foregoing disclosure of the unlocking or alternative locking process 500, the watercraft 102 is brought to a condition of readiness for maneuvering when a user approaches or alternatively activates the transmission device. Thus, actual key operation can be advantageously and conveniently avoided.

Figure 6:
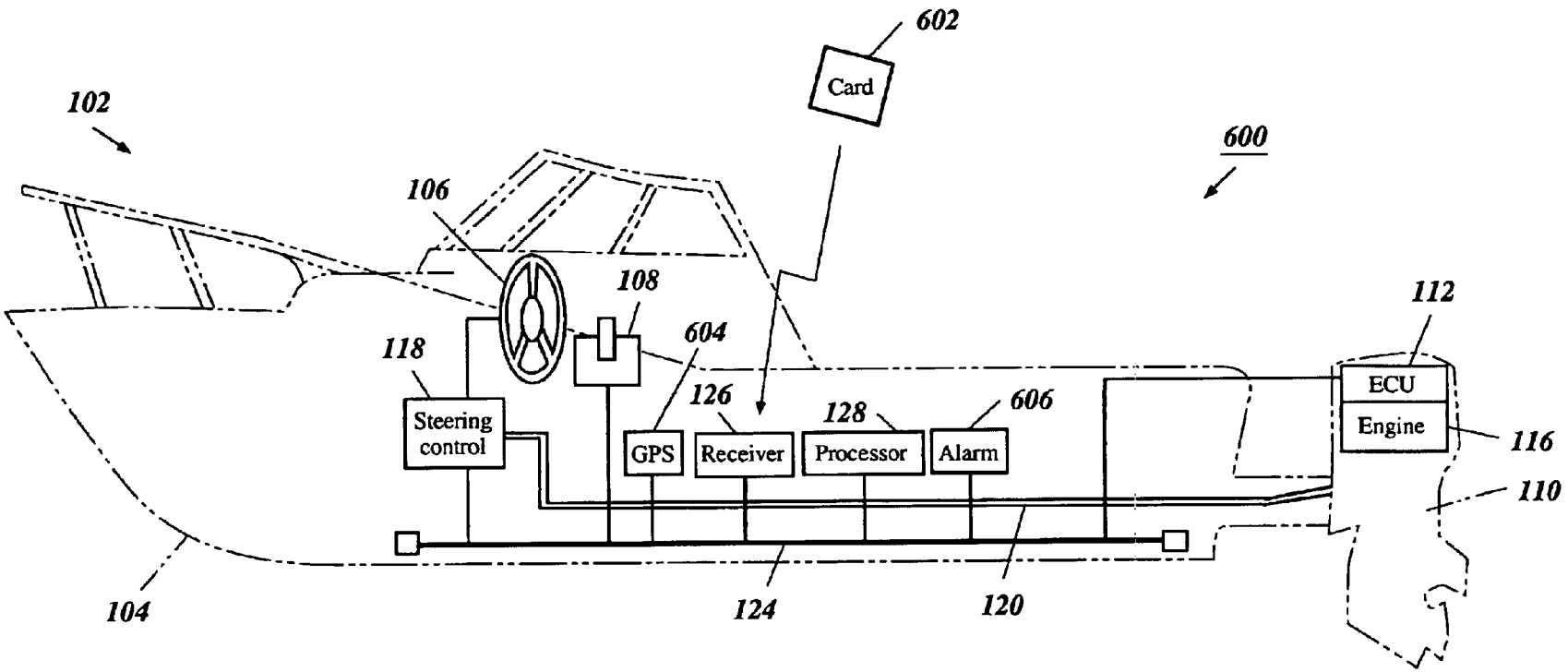
FIG. 6 is a block diagram of an alternative embodiment of a control system of a watercraft.
Figure 7:
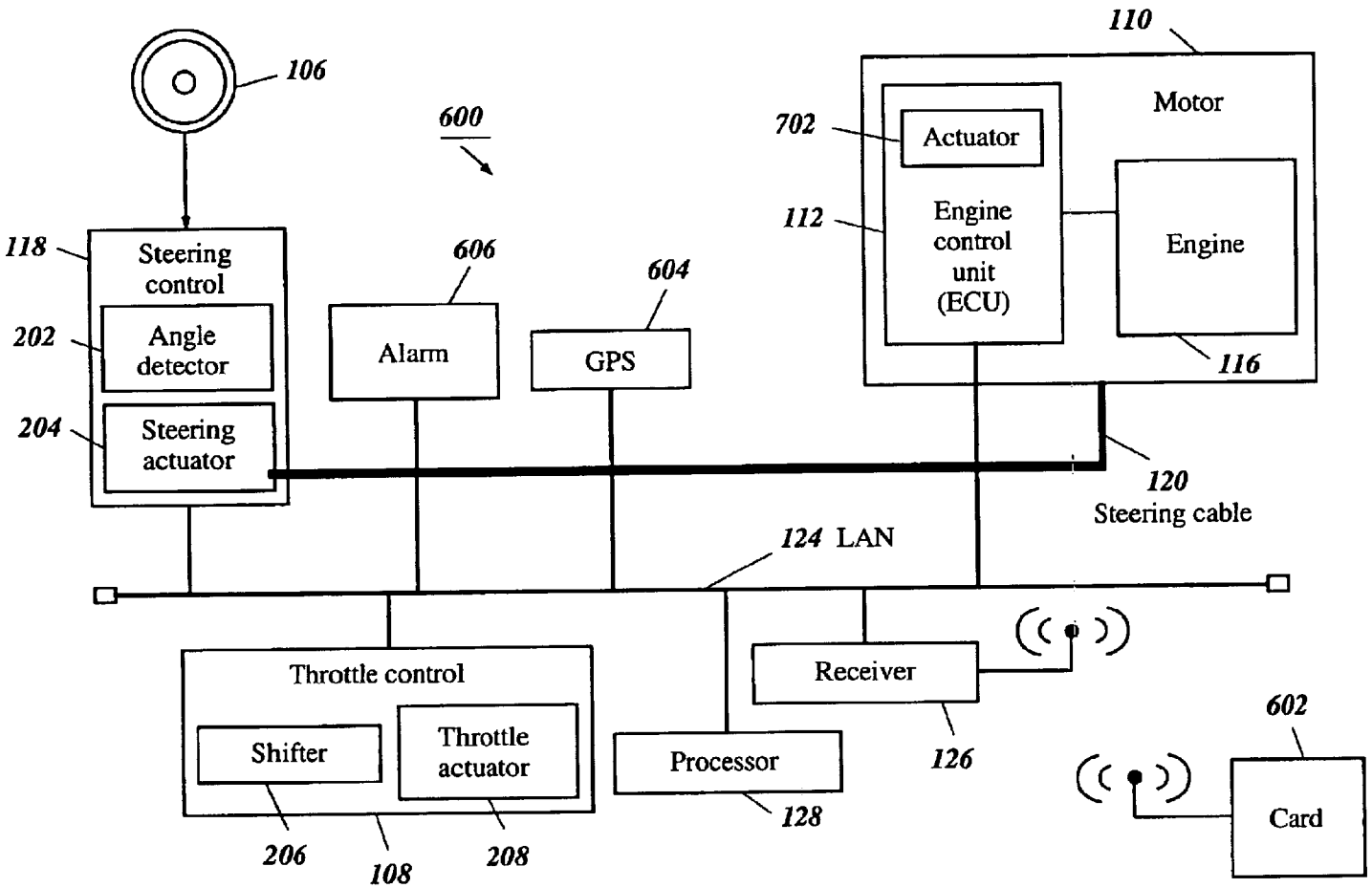
FIG. 7 is a more detailed block diagram of the control system of FIG. 6.
Figure 12:
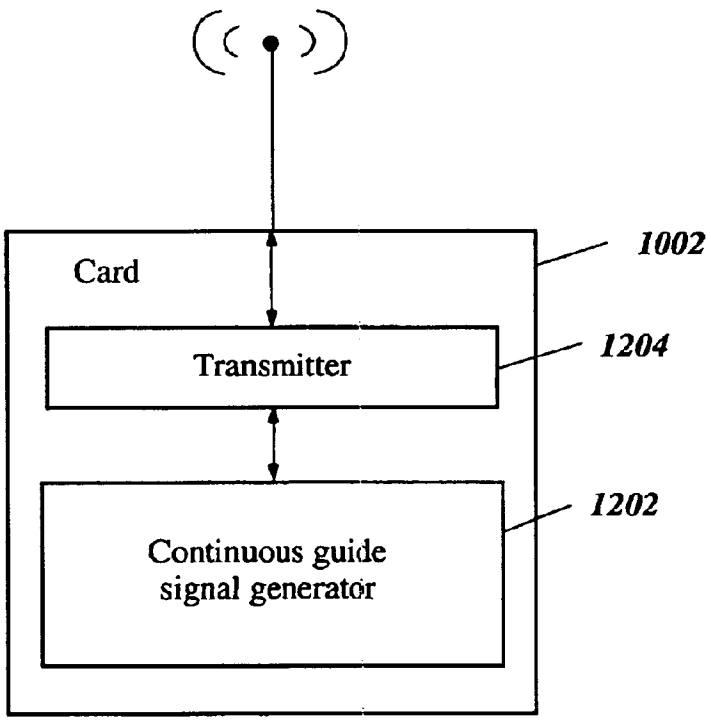
FIG. 12 is a block diagram of a transmission device of the control system of FIGS. 10 and 11.

FIGS. 6 and 7 illustrate a block diagram of a control system 600 of the watercraft 102, according to an embodiment of the invention. In order to facilitate a clear disclosure, aspects of the watercraft 102 have been reduced in or removed from FIGS. 6 and 7. For example, the starter relay, battery, and key control are represented in FIG. 7 as an actuator 702. As shown in FIG. 6, the control system 600 includes a transmission device or card 602, a guidance system including a GPS 604 and the processor 128, and an audio/visual interface such as an alarm 606. The card 602 transmits a signal which is used to return the watercraft 102 to the proximity of the holder of the card 602 when, for example, the holder falls off the watercraft 102, is diving, is swimming, or is otherwise moving away from the watercraft 102.

According to an embodiment, the GPS 604 provides positioning information to the processor 128 through LAN 124. The GPS 604 comprises a device in which the current location of the watercraft is detected through communication signals from a GPS satellite. The audio/visual interface receives the location information and converts it into human comprehendible information, such as, for example, an alarm, a speaker output, a light, or the like. Operation of the GPS 604 in connection with the control system 600 will be disclosed in further detail below with reference to FIG. 9.

Figure 8:
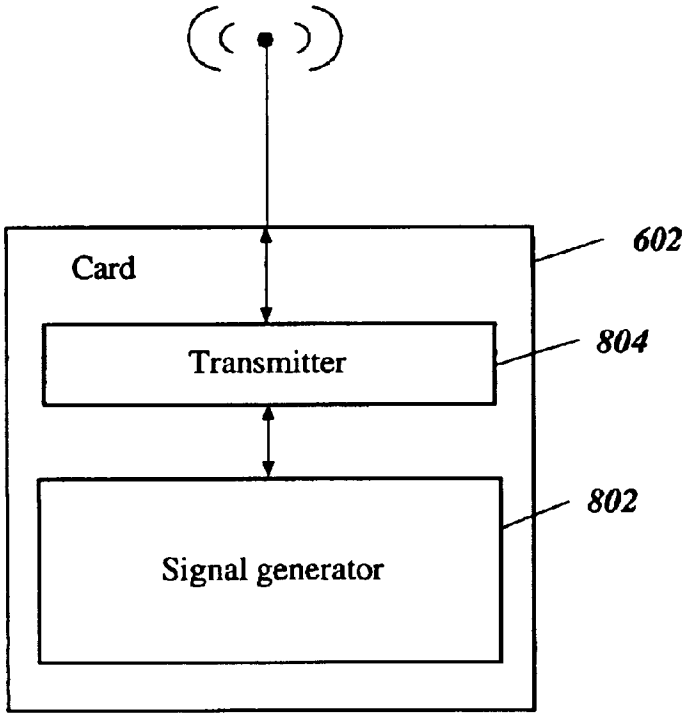
FIG. 8 is a block diagram of a transmission device of the control system of FIGS. 6 and 7.

FIG. 8 is a block diagram of the transmission device, such as the card 602 of the control system 600, according to an embodiment of the invention. As shown in FIG. 8, the card 602 includes a signal generator 802 and a transmitter 804. The signal generator 802 generates a signal expected by the receiver 126. The signal is transmitted by transmitter 804. According to an embodiment, the signal is other than the foregoing ID code 404; however, a skilled artisan will recognize from the disclosure herein the signal could be the ID code 404. In particular, the card 602 may be able to transmit the ID code 404, transmit another signal, or transmit multiple signals. According to one embodiment, the card 602 includes a button or activation mechanism for generating and outputting the signal, thereby instructing the control system 600 to enter into a pursuit mode where the watercraft 102 is guided to a specific location, or follows the holder of the card 602.

Figure 9:
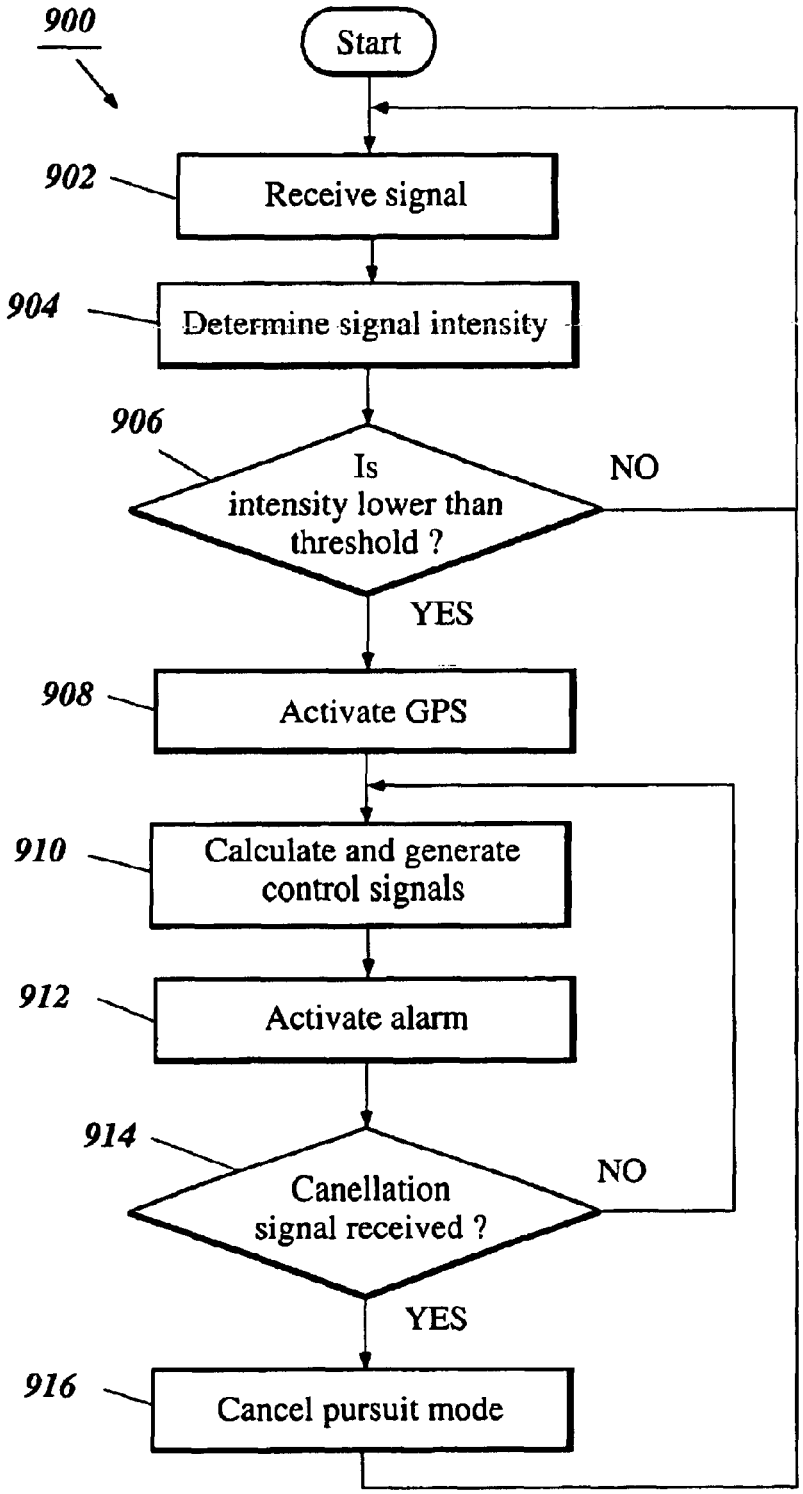
FIG. 9 is a flowchart of an guidance process performed by the control system of FIGS. 6 and 7.
Figure 10:
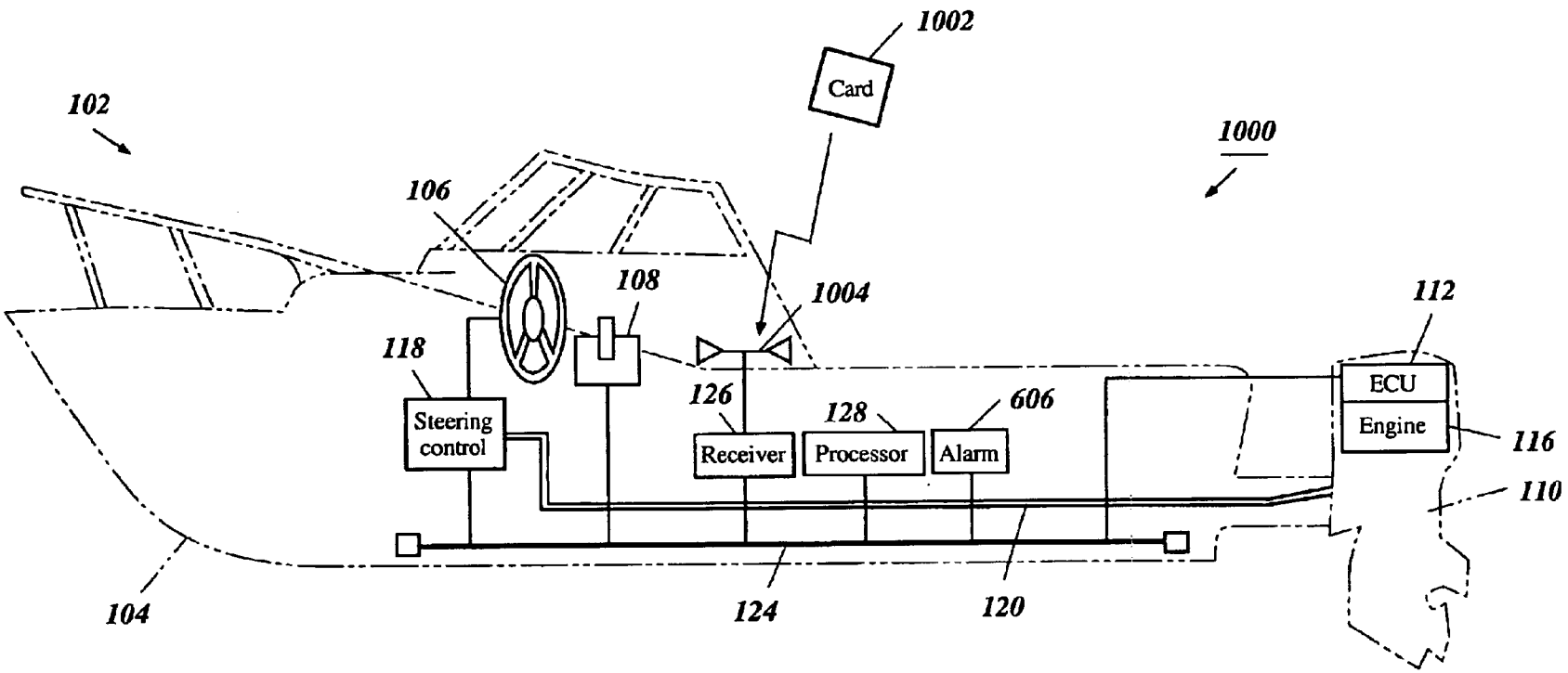
FIG. 10 is a block diagram of an alternative embodiment of a control system of watercraft.
Figure 11:
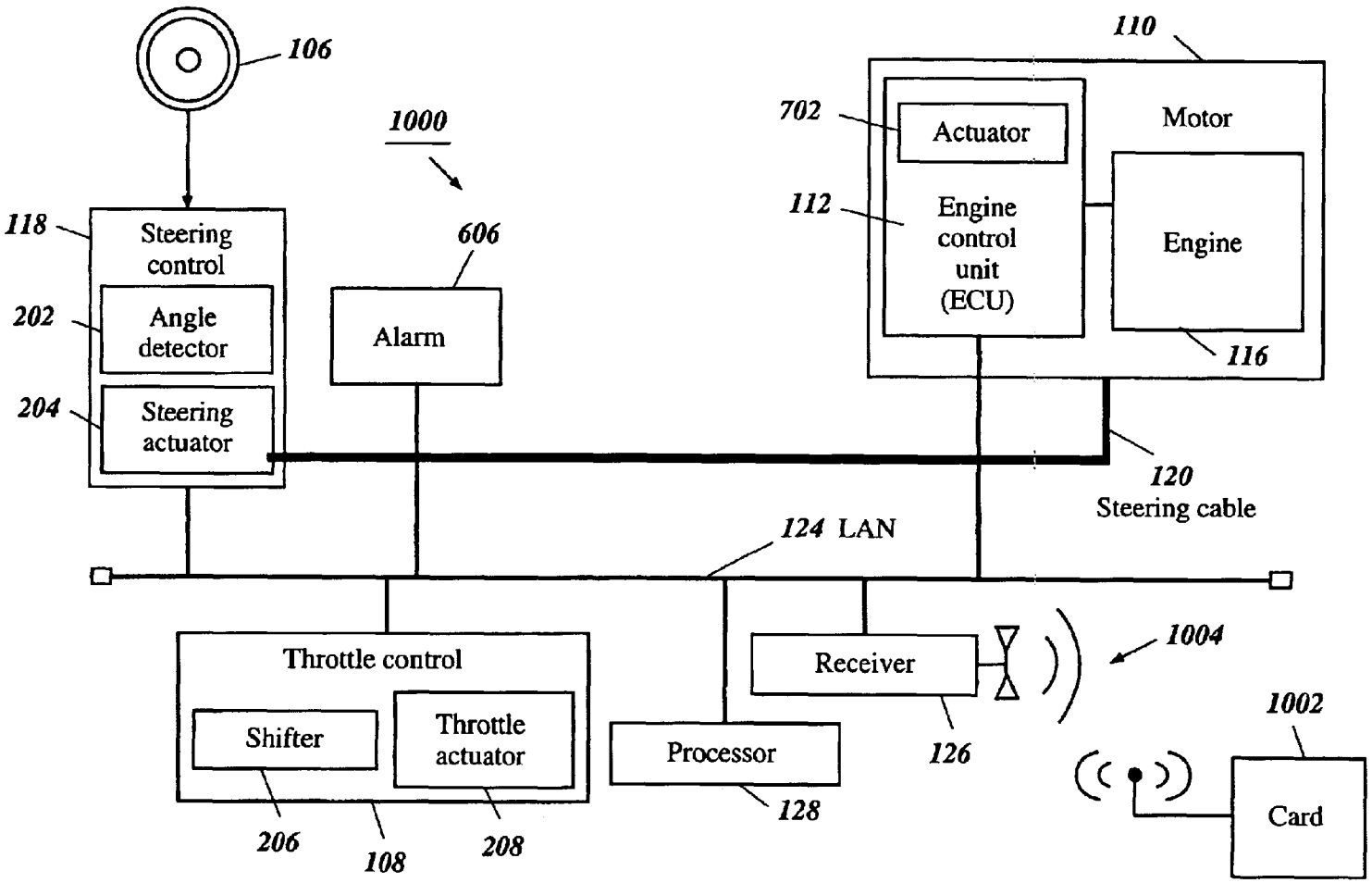
FIG. 11 is a more detailed block diagram of the control system of FIG. 10.
Figure 13:
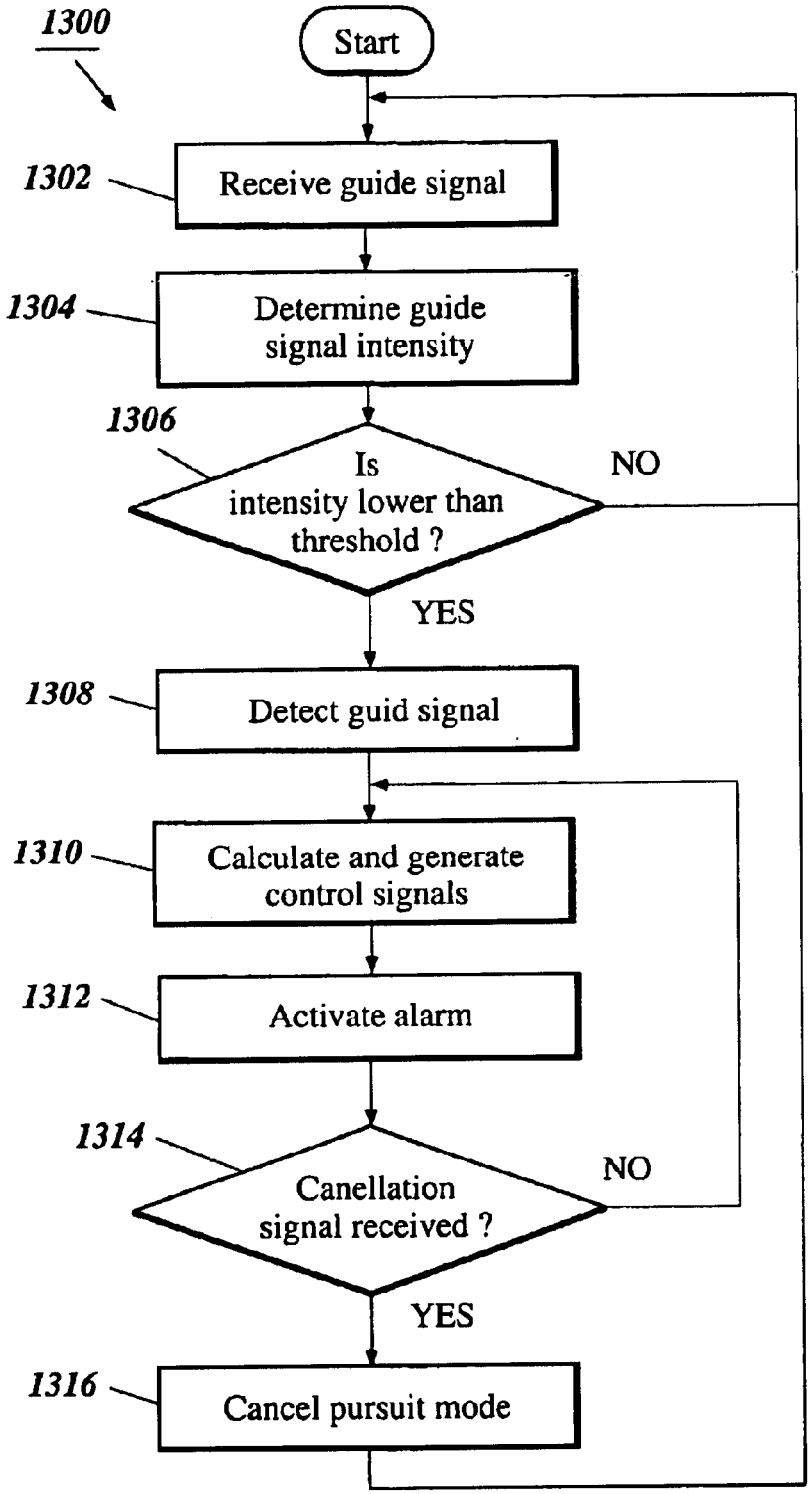
FIG. 13 is a flowchart of an guidance process performed by the control system of FIGS. 10 and 11.

FIG. 9 is a flowchart of an guidance process 900 performed by the control system 600 according to an embodiment of the invention. As shown in FIG. 9, the process 900 begins with a block 902, where the receiver 126 receives the signal generated by the card 602. At a block 904, the processor 128 determines the signal intensity, and at a block 906, the processor 128 determines whether the signal intensity is below a threshold value. The intensity detection can be performed by various methods, such as, for example, by determination of a signal-to-noise ratio of the received signal, or the like. The threshold intensity may be chosen to approximate a distance between the receiver 126 and the card 602 of about 3 meters to about 15 meters, or more preferably a distance between about 5 meters to about 10 meters.

When the signal intensity is above the threshold, the process 900 returns to the block 902 or, alternatively, ends. When the intensity is below the threshold, at a block 906, which means that the holder of the card 602 has moved away from the watercraft 102 for whatever reason, the process 900 proceeds to a block 908 where the GPS 604 is activated to determine positional information corresponding to a location P of the watercraft 102. At a block 910, the positional information is received by the processor 128, which calculates and generates control signals for guiding the watercraft 102 to the location P. According to an embodiment, the control signals include shift and throttle operations, steering control operations, and other operations such as trim adjustment, motor activation, or the like, needed to guide the watercraft 102 to the location P.

At a block 912, the processor 128 activates the alarm 606 indicating to anyone perceiving the audio and/or visual information of the alarm 606 that the watercraft 102 has entered an emergency or pursuit mode. At a block 914, the processor determines whether a pursuit cancellation signal has been received, such as, for example, an additional activation of the card 602, activation of a differing signal from the card 602, or the like. When the signal has not been received, the process 900 returns to the block 910, where the processor 128 continues to generate control signals to pursue the holder of the card 602. When, at a block 914, the processor 128 has received the pursuit cancellation signal, the processor 128, at a block 916, generates appropriate control signals to maintain the current location of the watercraft 102. The process 900 then returns to the block 902 and waits for activation of the card 602 or, alternatively, the process 900 ends.

Although the guidance process 900 is disclosed with reference to various embodiments, the invention is not intended to be limited thereby. Rather, a skilled artisan will recognize from the disclosure herein a wide number of alternatives. For example, the GPS 604 may continually output positional information such that the processor 128 may access information prior to the determination of a received signal intensity falling below the threshold, to thereby determine the desired return location. For example, since the time that the signal intensity becomes lower than a given value may be slightly later than the time that, for example, a driver fell off the watercraft 102, past positional information may be accessed to correct for the delay.

According to one embodiment, the desired location is a default location. According to another embodiment, the processor 128 stores representations of current locations, of signal intensity readings, or the like, thereby generating a stored history of the watercraft's changing positional information.

According to one embodiment, after the watercraft 102 has returned to the location P, the processor 128 may output control signals to lower engine speed so that the watercraft maneuvering conditions are such that the fallen driver can easily return to the watercraft. Based on the foregoing, the guidance process 900 advantageously enables the watercraft 602 to return to, for example, a location proximate an accident site.

Although the guidance process 900 is disclosed herein with reference to its preferred embodiment, the invention is not intended to be limited thereby. Rather, a skilled artisan will recognize from the disclosure herein various alternatives thereof. For example, because the processor 128 can determine signal intensity, the signal intensity may be repeatedly calculated and used in a block 914 to determine whether the watercraft 102 has returned to the proximity of the holder of the card 602 at the location P.

According to another embodiment disclosed with reference to FIGS. 10 through 13, a control system 1000 replaces the GPS 604 and employs a transmission device such as a card 1002 and one or more directional antennas 1004 to guide the watercraft 102 back to a location where the card 1002 is transmitting a continuous guide signal from a continuous guide signal generator 1202. The directional antennas 1004 can be positioned to have directionality in the horizontal direction of the hull 104. The foregoing embodiment advantageously provides pursuit of the holder of the card 1002 even when the holder is not the driver (e.g., the holder is a diver).

As will be understood from the disclosure herein, the control system 1000 may include the GPS 604, and the card 1002 may include a plurality of signal generators that generate a plurality of signals. The processor 128 may track the number of activations of the signal generator, to interpret differing instructions from the user. The processor 128 uses the directional antennas 1004 to determine the direction of the card holder, based at least in part on which antenna received the signal of the largest intensity.

Figure 14:
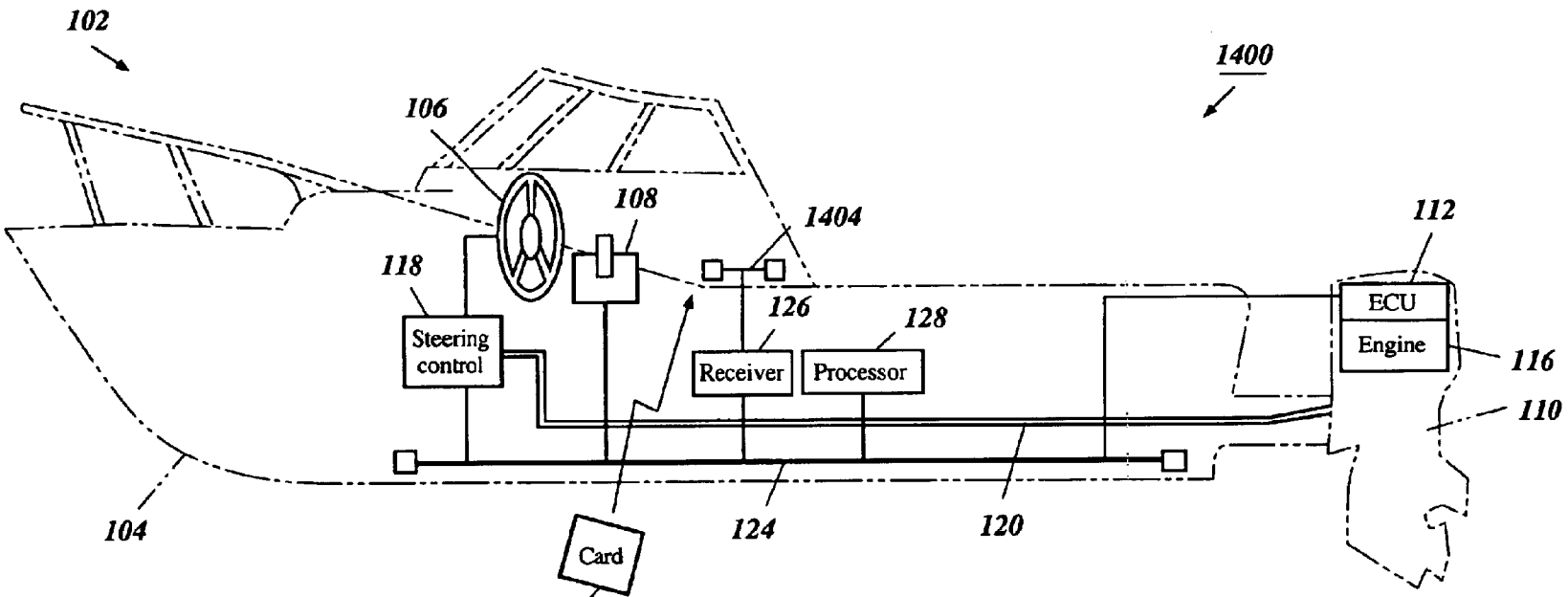
FIG. 14 is a block diagram of another alternative embodiment of a control system of a watercraft.
Figure 15:
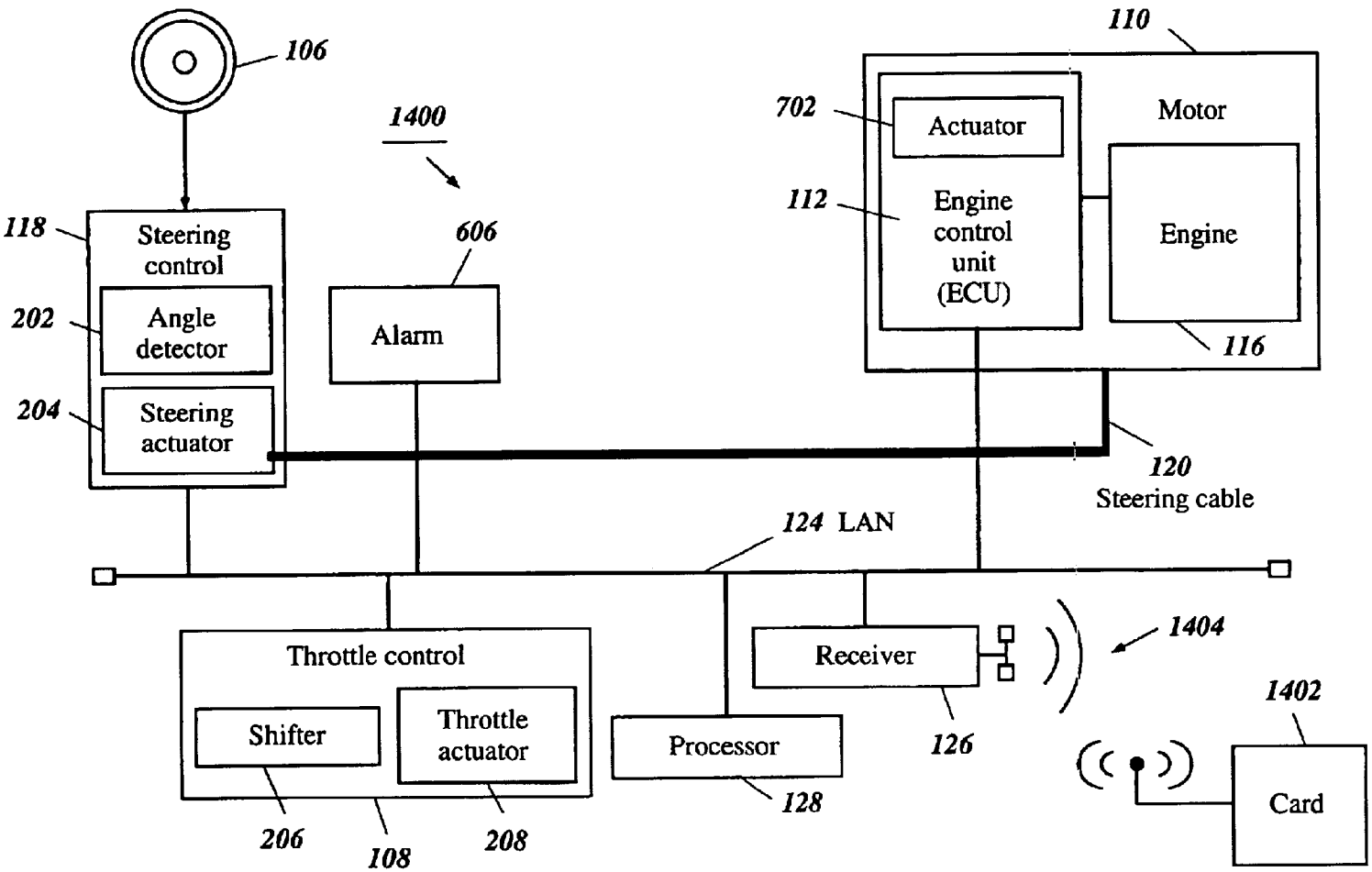
FIG. 15 is a more detailed block diagram of the control system of FIG. 14.
Figure 16:
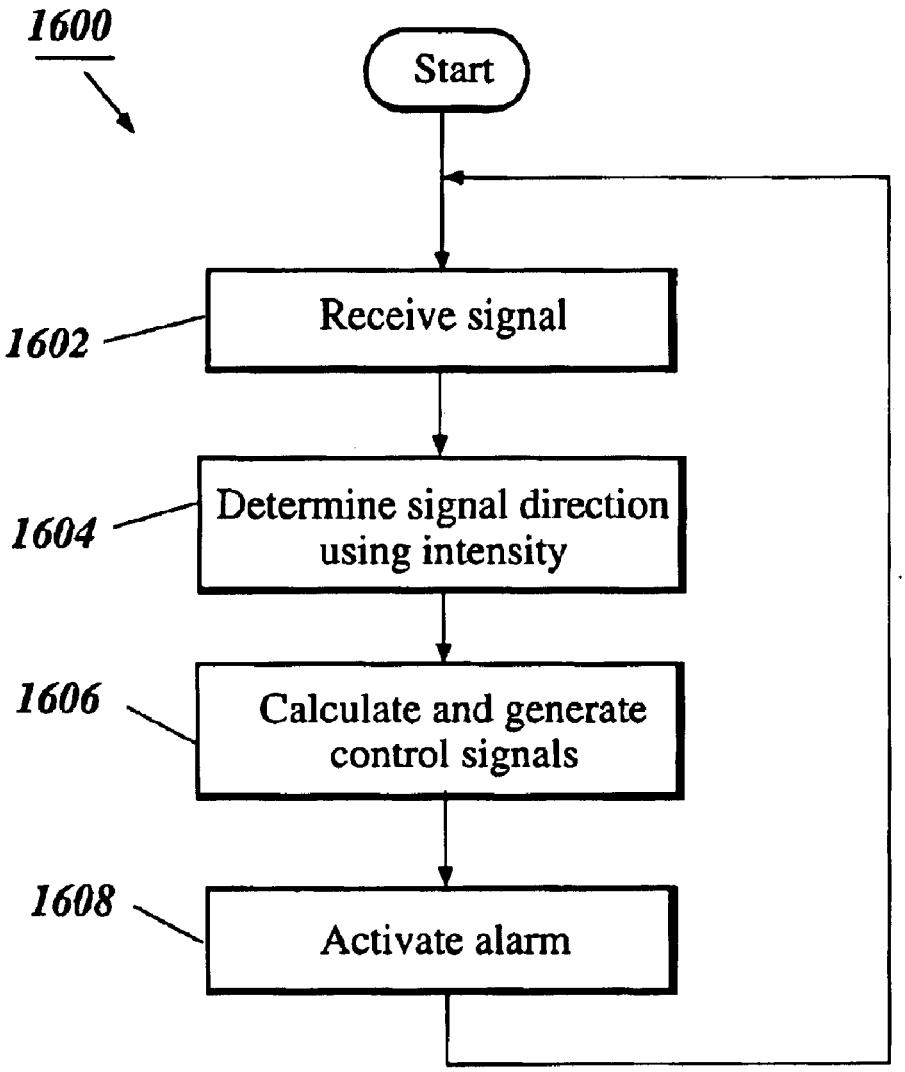
FIG. 16 is a flowchart of an guidance process performed by the control system of FIGS. 14 and 15.
Figure 17:
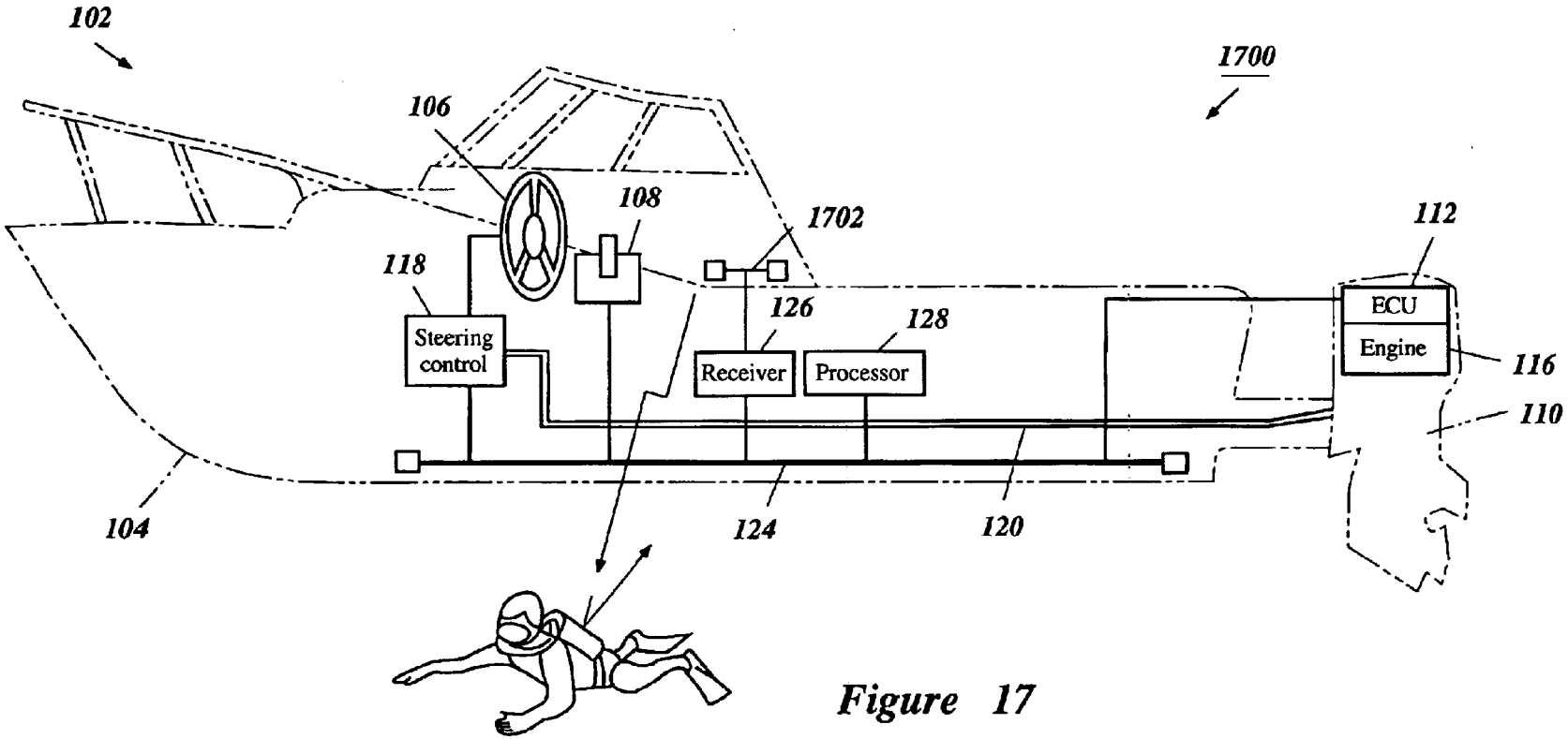
FIG. 17 is a block diagram of another alternative embodiment of a control system of a watercraft
Figure 18:
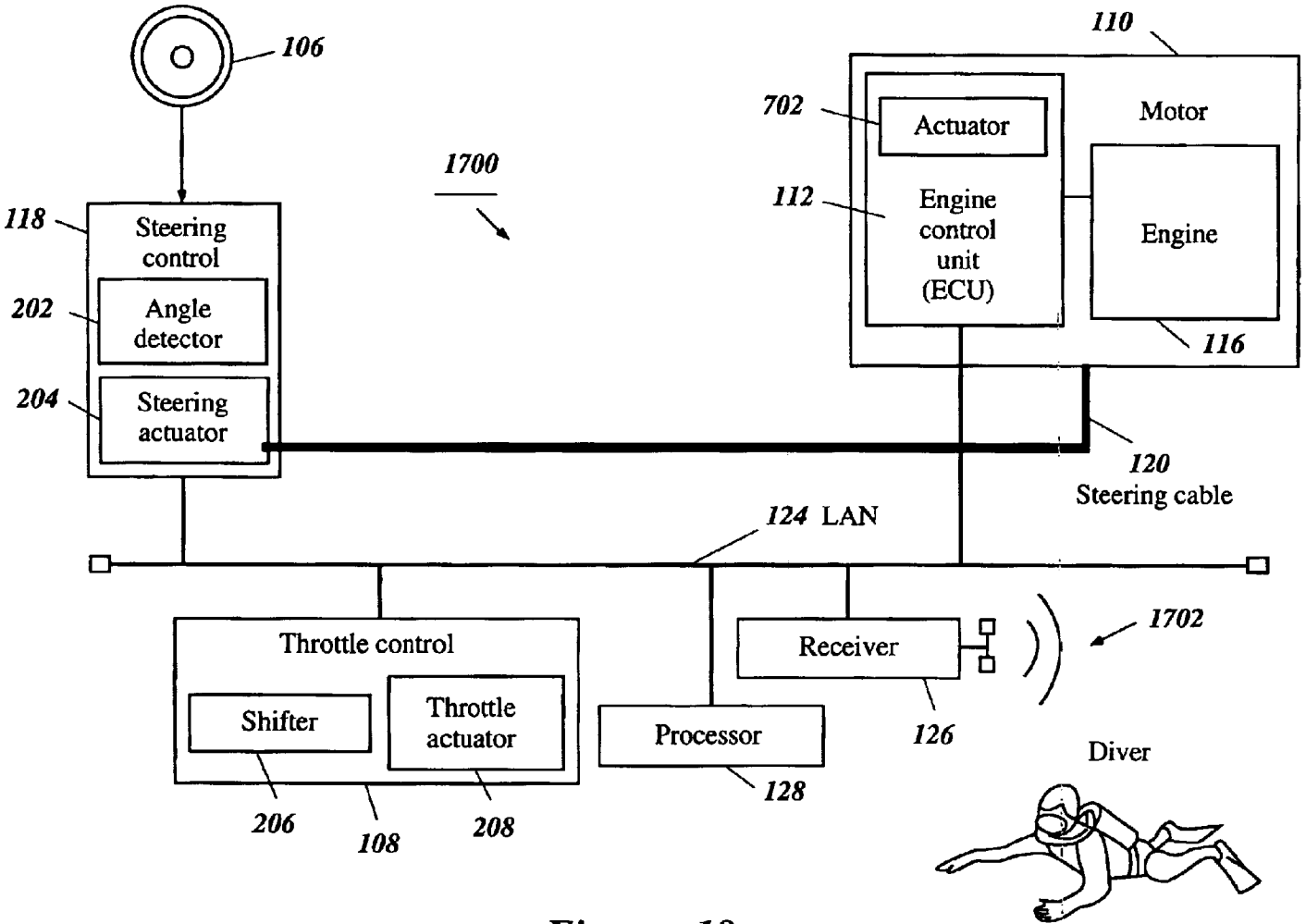
FIG. 18 is a more detailed block diagram of the control system of FIG. 17.
Figure 19:
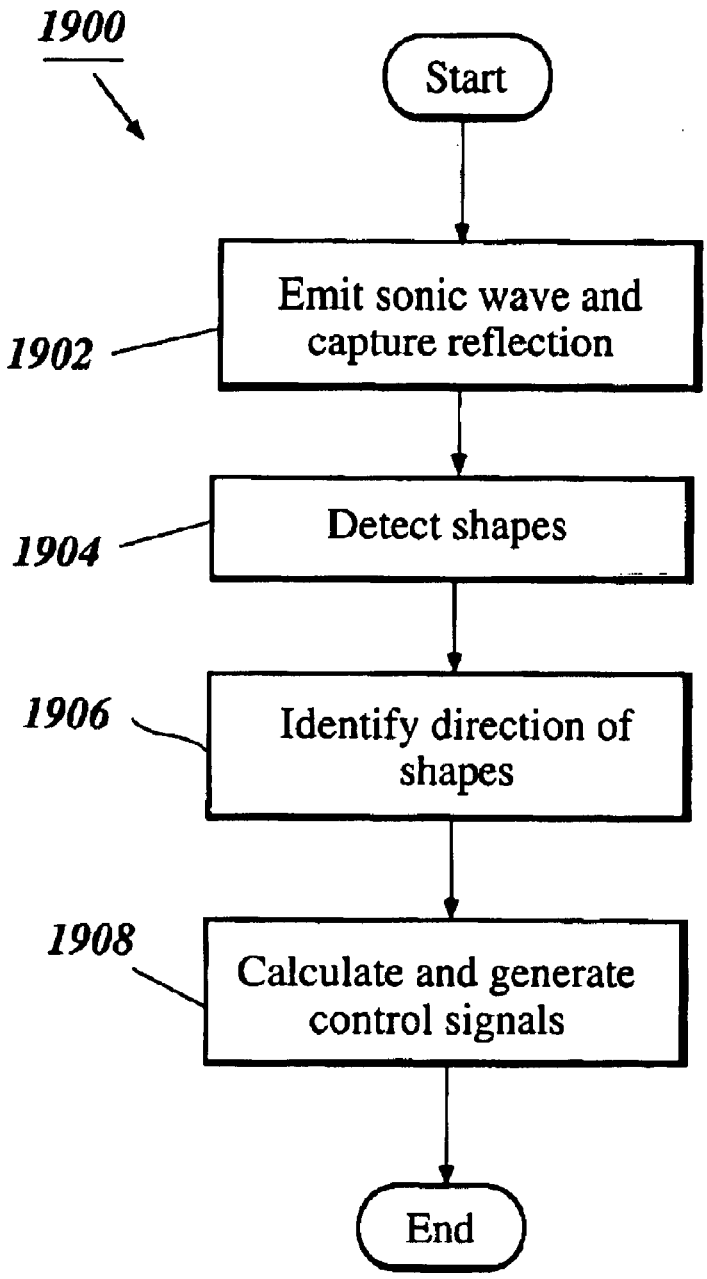
FIG. 19 is a flowchart of an guidance process performed by the control system of FIGS. 17 and 18.
Figure 20:
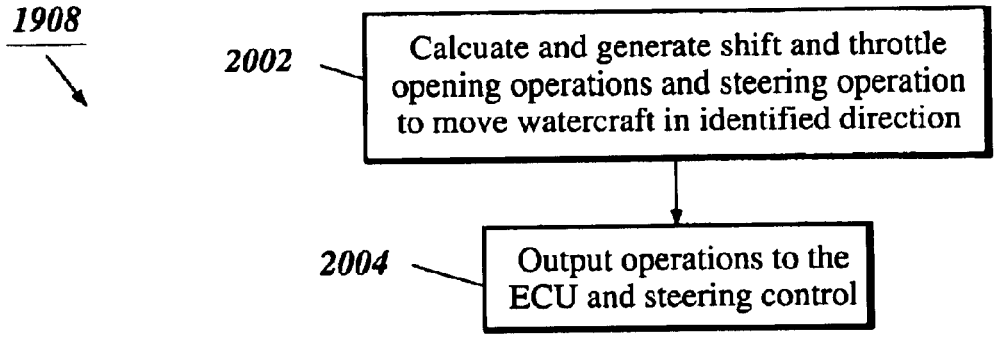
FIG. 20 is a flowchart of a portion of the guidance process FIG. 19.

According to another embodiment disclosed with reference to FIGS. 14 through 16, a control system 1400 includes a transmission device such as a card 1402. Moreover, the control system 1400 replaces the directional antennas 1004 and employs one or more ultrasonic antennas 1404, guide the watercraft 102 back to a location where the card 1004 is transmitting a continuous ultrasonic guide signal from a continuous ultrasonic guide signal generator. According to one embodiment, the ultrasonic wave antennas 1404 are positioned to have directionality in the horizontal direction with a slightly obliquely downward direction with respect to the hull 104.

When a person carrying the card 1402 initiates a dive and begins to move away from the watercraft 102, the control system 1400 guides the watercraft 102 to remain near and generally above the diver. Accordingly, the card 1402 preferably generates and transmits a signal, such as a signal having a small damping factor, which is unlikely to be significantly attenuated when propagated through water. For example, the signal is advantageously an ultrasonic wave.

According to another embodiment disclosed with reference to FIGS. 17 through 20, a control system 1700 replaces the directional antennas 1004 or the ultrasonic wave antennas 1402 of prior embodiments and employs one or more sonic wave receiving and emitting antennas 1702 to guide the watercraft 102 as the watercraft follows a diver. For example, according to one embodiment, the processor 128 processes signals representing the received or reflected sonic waves from the sonic wave receiving and emitting antennas 1702 and detects a human figure. Such detection is accomplished by, for example, analyzing patterns of the reflected wave and detecting a pattern specific to a human figure and different from a school of fish. Alternatively, the sonar devices may comprise one or more fish-finders that are adjusted to seek specific sizes of "fish" corresponding to sizes of humans. Based on the foregoing, the control system 1700 advantageously allows the watercraft 102 to pursue the diver In association with his movement.

According to another embodiment of the invention, the diver may carry a card, such as one or more of the cards 104, 604, or 1004. Through the use of one or more of the foregoing cards and corresponding programmatic functions designed for the processor 128, the watercraft 102 may pursue a specific diver, pursue more than one diver, pursue specific groups of divers, or the like, even when a plurality of divers are in the water. In cases where sonar technology is deployed in addition to other tracking and pursuing technologies, it may be sufficient for the processor 128 to use coarser data for sonar tracking because the other tracking methods can also be used to target specific divers.

Although the foregoing invention has been described in terms of certain preferred embodiments, other embodiments will be apparent to those of ordinary skill in the art from the disclosure herein. Additionally, other combinations, omissions, substitutions and modifications will be apparent to the skilled artisan in view of the disclosure herein. Accordingly, the present invention is not intended to be limited by the reaction of the preferred embodiments, but is to be defined by reference to the appended claims.

What is claimed is:

1. A control system for a watercraft providing wireless communication between a user's transmitting device and a processor on the watercraft, the control system comprising:

a portable transmitting device configured to transmit a signal; and a watercraft control system comprising:

a receiver configured to receive the transmitted signal;

a processor configured to communicate with the receiver to process the received signal and verify the received signal's authenticity, and configured to generate one or more operational commands when the received signal is authentic; and one or more controls of the watercraft including at least one of a steering control, a throttle control, and a rigging control, the one or more controls configured to communicate with the processor to receive and perform the one or more operational commands including mechanically positioning the rigging control, locking or unlocking the steering control, and locking or unlocking the throttle control, thereby preparing the watercraft for use.

2. The control system of claim 1, wherein the one or more controls include the steering control and the one or more operational commands includes locking and unlocking the steering control.

3. The control system of claim 1, wherein the one or more controls include the throttle control and the one or more operational commands includes locking and unlocking the throttle control.

4. The control system of claim 1, wherein the one or more controls include the rigging controls and the one or more operational commands includes adjusting the rigging controls.

5. The control system of claim 1, further comprising a second portable transmission device, wherein the processor can distinguish between signals from the portable transmission device and the second portable transmission device, and wherein processor generates operational commands based on predetermined configurations associated with each of the portable transmission device and the second portable transmission device.

6. The control system of claim 1, further comprising a guidance system which determines positional or directional information, wherein the processor is configured to communicate with the guidance system and generate one or more operational commands to guide the watercraft to a desired location based on the positional or directional information.

7. The control system of claim 6, wherein the guidance system comprises a global positioning system.

8. The control system of claim 6, wherein the guidance system comprises one or more directional antennas.

9. The control system of claim 8, wherein the transmitted signal comprises one or more radio-frequency signals.

10. The control system of claim 8, wherein the transmitted signal comprises one or more ultrasonic signals.

11. A control system for a watercraft providing pursuit of a diver, the control system comprising:

a transceiver configured to transmit sonar waves and receive reflections of the sonar waves from objects; and a processor configured to communicate with the transceiver to acquire signals representing the reflections, configured to determine which reflections represent desired shapes, and configured to generate one or more operational commands to guide the watercraft to a desired location proximate a location of the objects which correspond to one or more of the desired shapes.

12. A watercraft control device comprises:

means for receiving and monitoring a signal from a transmitting device;

means for detecting a direction of the transmitting device;

means for generating control signals for maneuvering a watercraft in said detected direction; and means for outputting said control signals to control devices such that said watercraft moves in said detected direction, wherein said transmitting device comprises a sonar transmitting device, and wherein said means for detecting a direction further comprises means for receiving a reflected sonar signal off one or more objects, means for recognizing shapes in said reflected sonar signal in order to determine which of the one or more objects to follow, and means for determining a direction of the object to follow.

13. The watercraft control device of claim 12, therein said transmitting device is wearable on a user of a watercraft.

14. The watercraft control device of claim 12, wherein said transmitting device is wearable on a diver.

* * * * *

UNITED STATES PATENT AND TRADEMARK OFFICE

CERTIFICATE OF CORRECTION

PATENT NO. : 6,878,019 B2
APPLICATION NO. : 10/280262
DATED : April 12, 2005
INVENTOR(S) : Isao Kanno et al.

It is certified that error appears in the above-identified patent and that said Letters Patent is hereby corrected as shown below:

Column 1, Line 1, please delete “Marin” and insert -- Marine --, therefore.

Column 12, Line 39, Claim 13, please delete “therein” and insert -- wherein --, therefore.

Signed and Sealed this

Twenty-fourth Day of July, 2007

JON W. DUDAS
*Director of the United States Patent and Trademark Office*